US005303840A

United States Patent [19]

Sharp

[11] Patent Number: 5,303,840

[45] **Date of Patent: * Apr. 19, 1994**

[54] STORAGE TANKS HAVING STRENGTHENED WALLS

[76] Inventor: Bruce R. Sharp, 126 Leland Way, Marco Island, Fla. 33937

[ * ] Notice: The portion of the term of this patent subsequent to Sep. 26, 2006 has been disclaimed.

[21] Appl. No.: 717,686

[22] Filed: Jun. 19, 1991

Related U.S. Application Data

[63] Continuation of Ser. No. 464,460, Jan. 12, 1990.

[51] Int. Cl.[5] ..... B65D 88/76

[52] U.S. Cl. ..... 220/469; 220/445; 220/466; 73/49.2

[58] Field of Search ..... 220/469, 445, 453, 465, 220/466; 73/49.2 T

[56] References Cited

U.S. PATENT DOCUMENTS

| | | | |
|---|---|---|---|
| 4,739,659 | 4/1988 | Sharp | 220/445 |
| 4,781,777 | 11/1988 | Pugnale et al. | 220/426 |
| 4,869,386 | 9/1989 | Sharp | 220/453 |

*Primary Examiner*—Allan N. Shoap
*Assistant Examiner*—S. Castellano
*Attorney, Agent, or Firm*—Charles R. Wilson

[57] ABSTRACT

A method of making a storage tank system comprises forming a series of outer wall sections over a cylindrical-shaped inner storage tank. Each outer wall section is bonded to the inner tank at a distance of less than about ½ inch in height from the inner tank. The inner storage tank is strengthened by the wall sections. Partial secondary containment is provided by the outer wall sections. A monitored storage tank system with partial secondary containment is provided by the use of a leak detection system to monitor the closed spaces defined by the outer wall sections and the inner storage tank.

20 Claims, 2 Drawing Sheets

STORAGE TANKS HAVING STRENGTHENED WALLS

This is a continuation of application Ser. No. 07/464,460 filed Jan. 12, 1990.

This invention relates to storage tanks. More particularly, the invention relates to underground storage tanks with strengthened walls.

BACKGROUND OF THE INVENTION

Commercial and industrial liquids of all types are stored in underground storage tanks. The capacity of such tanks are at least 1,000 gallons liquid and typically are 10,000 to 20,000 gallons liquid. The tanks presently being sold are made of metal or a fibrous reinforced resinous material. The metal storage tanks are made of a heavy gauge steel and are cylindrical-shaped. The fibrous reinforced resinous material tanks are usually ribbed for added strength.

Regardless of the material used to make the underground storage tanks, the tanks must have sufficient wall strength to withstand internal and external weight forces. Increased wall thickness does increase wall strength, but also increases the cost of producing the tank and difficulty in installing it. Clearly, any leakage from the tanks, whether due to a complete collapse of a small hole can have a substantial impact on the environment of health of nearby residents.

A need for a underground storage tank which can safely hold a substantial amount of potentially dangerous liquid is well recognized. Double walls storage tanks have been suggested. Various new methods of building tanks have also been suggested in recently issued patents. Still more efficient and cheaper methods of making reliable storage tanks are needed. In accord with this continuing need, there has been developed a storage tank with strengthened walls and optionally leak detection capability. The tanks are economically built and are installed with conventionally used equipment.

SUMMARY OF THE INVENTION

A method of building a strengthened storage tank comprises forming a series of spaced outer wall sections over a cylindrical-shaped storage tank. Each wall section extends circumferentially around the storage tank and each section is attached along its edges to the storage tank. Closed areas formed by the spaced wall sections are capable of containing leaked liquid. The tank walls between the spaced wall sections are optionally covered with a resinous material for enhanced leak protection.

DETAILED DESCRIPTION OF THE INVENTION

Figure 1:
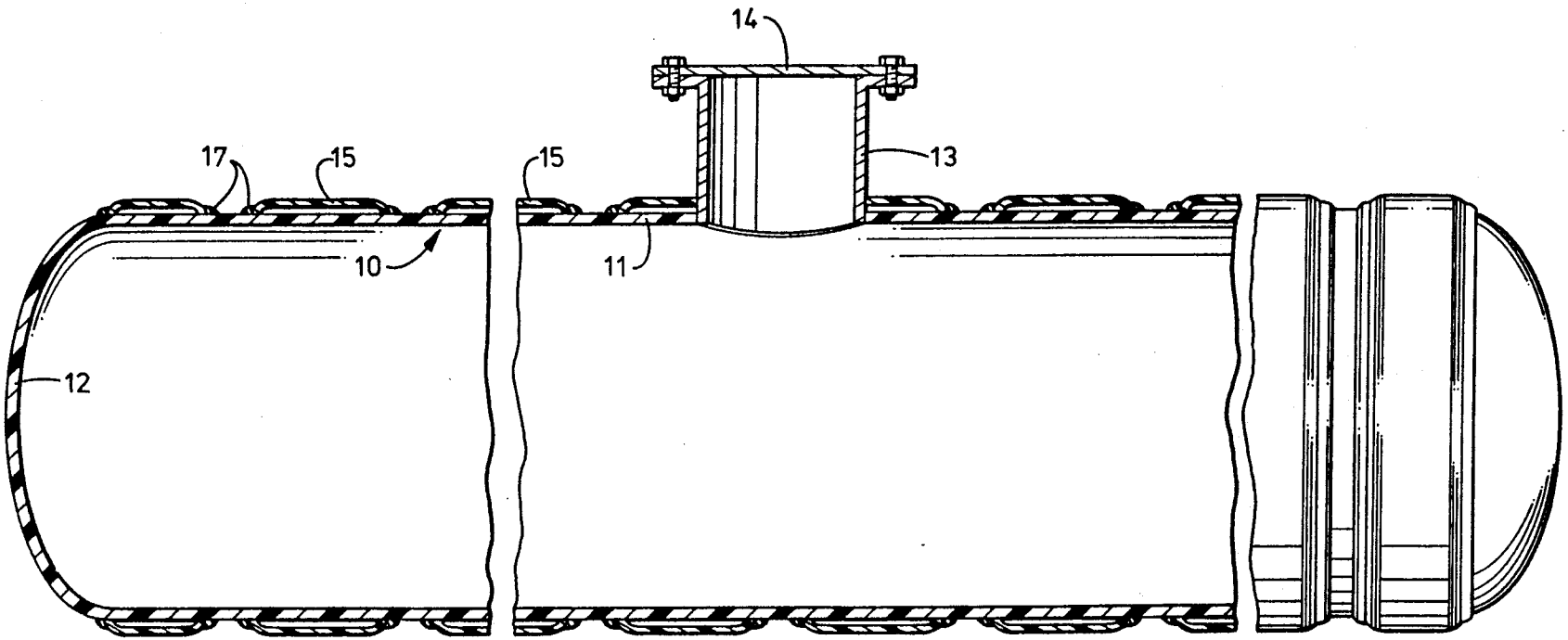
FIG. 1 is a side view of a storage tank system of this invention.

With reference to FIG. 1, there is shown a storage tank system of this invention. The inner storage tank 10 is comprised of a main cylindrical-shaped body 11, end walls 12, and manway 13. The main body 11 and end walls 12 are made of a conventional fibrous reinforced resinous material. Steel can also be used to make the storage tank. Not illustrated but within the spirit of this invention are those tanks wherein the end walls are flat and those tanks not having manways.

A sufficient number of openings are found in the storage tank 10 to allow for various access lines to the interior of the tank. For instance, a fill pipe, dispensing line and vent pipe can enter the storage tank at various points in the tank's surface, but preferably all enter through cover 14 of manway 13.

In accord with this invention, initially a series of spaced outer wall sections 15 are formed over the inner storage tank. The wall sections extend circumferentially around the inner storage tank. Each section is attached along both of its edges to the storage tank. The mid portions of the sections between the edges are not attached to the tank so that a closed space 16 exists under each wall section. The outer wall sections extend less than about ½ inch in height from the inner tank wall, preferably from about 1/64 inch to about ¼ inch. Portions of the wall sections may contact the inner tank wall 11. Such contact is not detrimental to the storage tank system's performance provided the two walls remain at least partially separated i.e. they are not sealed together. The closed spaces 16 provide an annular containment area for receiving liquid which may leak through the inner storage tank's walls.

The width of an outer wall section 15 ranges from about twelve inches to about sixty inches. The preferred width of a section is from about twelve inches to about thirty-six inches. The most preferred width for each outer wall section is from about fourteen inches to about twenty inches. About one-half inch to about six inches, preferably about one inch to about three inches separate the individual outer wall sections. The preferred wall section widths and spacing varies based on structural design and size of the tank. Generally, at least about seventy percent of the main cylindrical-shaped body is covered by the wall sections. The aforementioned preferred widths are for a storage tank having a diameter of from about four feet to about twelve feet.

The outer wall section edges are attached along their entire lengths to the inner storage tank. The bonding technique used to secure outer wall sections to the walls of the inner tank will depend on the materials of construction of the outer wall sections, per se, and the inner tank wall surface. Adhesive, caulking and welds can be used. Preferably, the wall sections are made of fibrous reinforced resinous material and the bonding is accomplished using an overlay of the same material. When the inner tank is made of metal, it may be necessary to first sand blast the areas of attachment to get good adhesion with the overlays. The overlays can, though need not mush, cover the inner wall areas between the wall sections.

Figure 2:
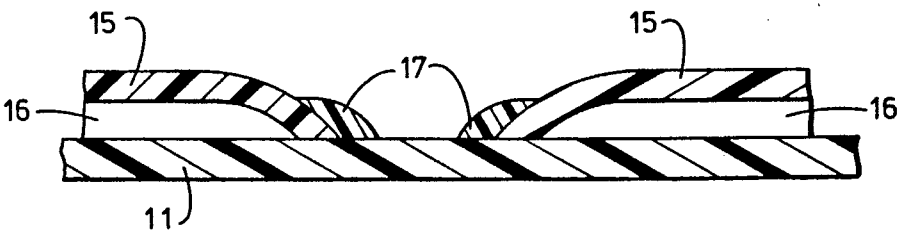
FIG. 2 is an enlarged partial sectional view showing a wall area of the storage tank system of FIG. 1.

One method of forming the wall sections is to initially place solid sheet material around the inner tank's cylindrical-shaped body. Examples of such sheets include metal sheets and fiberglass/resin sheets. The metal sheet can be a thin gauge steel sheet, preferably with a diamond grid pattern on the surface which faces the inner tank. The fiberglass resin sheet preferably has a stucco appearance on the side facing the inner tank. It is preferred that the solid sheet material has an irregular surface on at least one side to ensure a seal is not formed by its contact with the inner tank walls. An overlay 17 is next applied over the edges of the outer wall sections so as to secure each wall section to the tank wall. FIGS. 1 and 2 illustrate the use of a fibrous reinforced resinous sheet material and fibrous reinforced resinous overlay material.

The resultant storage tank system has a number of advantages. The basic inner storage tank has substantially increased strength due to the spaced outer wall sections. The wall sections are able to absorb much of the external ground forces that storage tanks of the type used in the invention normally encounter as well as movements caused by minor earthquakes. The very nature of the wall sections allows a certain degree of deflection without cracking or collapsing. It is even possible to use an inner storage tank with a less than normal wall thickness because of the added strength provided by the wall sections. This feature translates into a reduced inner tank cost. True secondary containment of the liquid in the storage tank is not provided because of the fact certain areas of the tank's wall are not covered or encased. However, the distance between wall sections is so small that any crack in the tank will likely be under a wall section. All the above advantages are obtained without a substantial, if any, cost increase.

Figure 3:
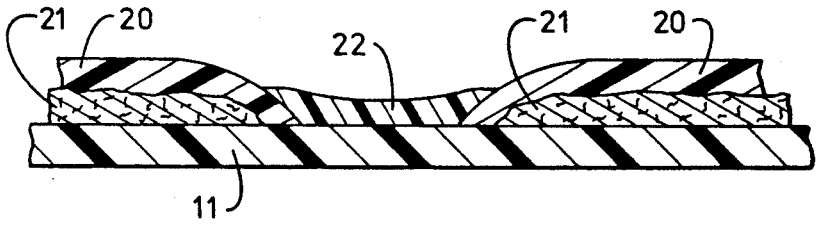
FIG. 3 is an enlarged partial sectional view showing a wall area of another storage tank system of this invention wherein a spacing material is used in formation of outer wall sections.

FIG. 3 shows a wall area of another storage tank system of the invention. Wall sections 20 shown in FIG. 3 are made of a fibrous reinforced resinous material. The wall sections 20 are formed in one method by first applying laterally spaced layers of fibrous reinforcing material 21 on the outer surface of the tank 10. The fibrous reinforcing material can take on many different physical shapes and structures, variously referred to as matting, nets, screens, meshes, continuous strands, and chopped strands. Examples of fibrous materials include fiberglass, nylon, and other synthetic fibrous materials. The fibrous material, if in sheet form, is laid onto the storage tank as a continuous matting. Each section has a width and a spacing as described with reference to the wall sections of FIGS. 1–2. The thickness of the fibrous material is great enough that a subsequently applied resinous material will not be able to completely penetrate through it and seal to the tank wall. Once the fibrous reinforcing material is applied, a resinous material is next applied to the reinforcing material and thereafter cured. As shown, a fibrous reinforcing material 21 has a lower portion as is and an upper portion substantially saturated with resinous material and cured to form wall section 20. If more wall thickness is desired additional resinous material and fibrous reinforcing material may be applied until the desired wall thickness is reached. A fibrous reinforced resinous overlay 22 is used to adhere the wall sections of the tank. The overlay 22 extends all the way across the tank between adjacent wall sections.

Several different resinous materials are known for the purpose of reinforcing fibrous material. Such materials include polyesters, e.g. vinylesters, isophthalic polyesters, polyurethane, and polyepoxide. The listed resinous materials used in the construction of the wall sections are not all inclusive, but only illustrative of some of the resinous materials which can be used.

Alternatively, the fibrous material is applied in the form of chopped strands along with the resinous materials described in the previous paragraph. In this embodiment, a separating material discussed in following paragraphs must be applied to the tank walls where the sections are to be formed to keep the tank wall and wall sections separated. Thus, the chopped strand and resinous material are sprayed from separate nozzles of the same spray gun and form the spaced outer wall sections as the resin cures. The overlapping of spray and fibrous material forming the sections on the tank wall adheres to the tank at the edges of the sections. Still another method of forming the outer wall sections is by filament windings. In this method continuous reinforcing fibrous strands are impregnated with resinous material and then wrapped in a crossing pattern over limited areas of the inner tank. A separating material means must be used in this method also.

When needed, a separating material having an least partially impervious outer planar surface is applied in spaced sections to the surface area on the tank's outer surface. The purpose of the impervious outer surface on the separating material is to ensure that the subsequently applied fibrous reinforcing material and resinous material which form the wall sections will not penetrate and seal to the storage tank.

Separating materials include solid polymeric films, corrugated sheets, irregular surfaced sheets, and foraminous or porous materials which are sealed on at least one side. Many pliable or semi-rigid materials are usable. Examples of such material are polyethylene, jute, polyurethane foam, polyester foam, polyether foam, fiberglass matting, cotton matting, nylon matting, corrugated cardboard, steel sheets with an irregular surface, fiberglass resinous sheets with an irregular surface, and asbestos which range from about 0.01 inches to almost ½ inch in thickness. A heat seal or sealing material, e.g. a polymeric coating, or a impervious wrapping such as polyethylene sheeting is used on one surface of any foraminous materials when needed to prevent substantial saturation with a subsequently applied resinous material. Wax, which is subsequently heated and removed, is also used as a separating material.

The minimum thickness of the separating material is sufficient to prevent the subsequently applied wall section from adhering to the storage tank. Accordingly, any shrinkage resulting from formation of the wall section must be accounted for by having a sealed material thick enough to be partially collapsed, but not form a compression seal between the walls.

Figure 4:
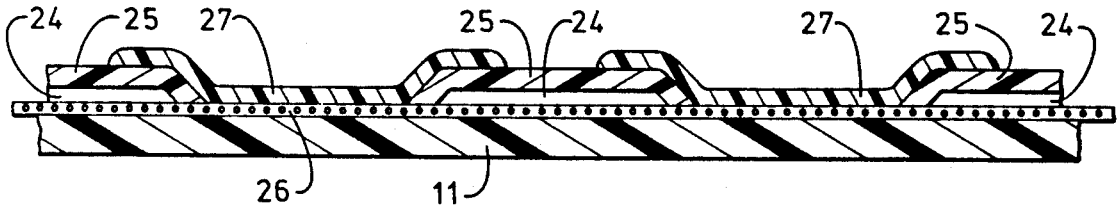
FIG. 4 is an enlarged partial sectional view of a wall area of still another storage tank system of the invention showing the use of monitor means for detecting leakage.

With reference to FIG. 4 there is shown a storage tank system of the type described in FIG. 1 wherein the spaces covered by the wall sections are monitored. The spaces are independently monitored or, preferably, the spaces 24 enclosed by the wall sections 25 are in communication. This is accomplished in one method by laying at least one aperture tube 26 along the length of the inner tank 10 prior to forming the outer wall sections thereon. Subsequent steps of securing the sections to the inner tank are done in a fashion above described. As shown, the areas of the storage tank between the wall sections are covered with a fibrous reinforced resinous overlay 27. Preferably, at least two aperture tubes are used with one being positioned along the bottom of the tank and one along the top of the tank. Alternatively, a tube or rod is used in place of the aperture tube and removed after the final wall section is formed. Vacuum can be used to collapse the walls of the tube to facilitate its removal. The result being a tank system with a tunnel extending the length of the inner tank's outside surface. Still other ways can be used to provide communication throughout the enclosed areas.

An of well know and commercially available monitor means are used for monitoring the closed spaces. For example, the closed space can be placed either under a non-atmospheric pressure, i.e. a positive or negative air pressure. Detection means associated with the closed space is capable of detecting any change in pressure resulting from a leak in the overlay or the storage tank. Thus, there can be provided a means for maintaining the closed space under a negative pressure. A conventional vacuum pump, together with an associated pressure regulator can be used. A pressure change sensor is a part of the detection means. A pressure gauge serves this purpose adequately. Optionally, an alarm system can be electronically linked with the pressure sensor to audibly or visually warn of a preset significant pressure change. A vacuum is preferred because of a resultant increased composite strength of the storage tank system by drawing the inner tank and outer wall sections together.

Another embodiment of the detection means utilizes an analyzer capable of detecting the liquid being stored. Thus, the detection means comprises the analyzer which is communication with the closed annular spaces. Preferably, a vacuum means for withdrawing gaseous material from the closed spaces is used for the purpose of obtaining a sample.

Still another detection means utilizes a probe to monitor for leakage at or near the bottom of the closed annular space. The probe is capable of detecting preselected liquids or gases. In this embodiment, leakage will ultimately seep to the bottom of the closed annular spaces and be detected. Detecting liquid can also be used as part of a detection means. Thus, a non-polluting liquid is used to fill the closed annular spaces and an access tube is installed leading to ground level. A sight glass at the access tube's end allows a visual observation of any change in detecting liquid level.

All the leak detection means discussed above can be electronically linked with an alarm system to audibly or visually warn of a pre-set significant change in any of the closed annular spaces. The leak detection means and secondary containment means allow for an early warning of a deterioration of either the primary or secondary containment means thereby permitting the necessary repair work to be done before any significant soil or water contamination has occurred.

While the invention has been described with respect to preferred embodiment, it is understood that various modifications may be made without departing form the spirit of the subject invention as defined by the appended claims. All obvious variations are within the scope of the claims.

What is claimed is:

1. A storage tank system having enhanced wall strength, said tank system comprising:

(a) an inner storage tank having a cylindrical-shaped main body and end walls; and (b) a set of outer wall sections covering at least about seventy percent of the main body, wherein lengthwise edges of each outer wall section are attached to the cylindrical-shaped main body so that each outer wall section extends circumferentially around the cylindrical-shaped main body with a mid-portion thereof less than about one-half inch from the main body to form an annular containment area thereunder, further wherein each outer wall section is from about twelve inches to about sixty inches in width and is from about one-half inch to about six inches separated from an adjacent outer wall section.

2. The storage tank system of claim 1 wherein the outer wall sections are from about 1/64 inch to about ¼ inch in height from the inner storage tank main body.

3. The storage tank system of claim 2 wherein each outer wall section is separated from an adjacent outer wall section by from about one inch to about three inches.

4. The storage tank system of claim 3 wherein each outer wall section is about twelve inches to about thirty-six inches in width.

5. The storage tank system of claim 4 wherein each outer wall section is about fourteen inches to about twenty inches in width.

6. The storage tank system of claim 1 wherein the outer wall sections are secured to the inner storage tank by a fibrous reinforced resinous material.

7. The storage tank system of claim 6 wherein the outer wall sections are made of fibrous reinforcing material and resinous material.

8. The storage tank system of claim 7 further wherein a separating material is positioned under each outer wall section.

9. The storage tank system of claim 8 wherein the separating material is selected from the group consisting of a foam, matting, net, screen and mesh.

10. The storage tank system of claim 1 wherein portions of the outer wall sections are in non-sealing contact with the main body other than where the wall sections are attached thereto.

11. The storage tank system of claim 1 further comprising monitor means in communication with at least one of the annular containment areas for the purpose of detecting a leak in the inner storage tank or outer wall sections.

12. A method of building a storage tank system having enhanced wall strength, comprising the steps of:

(a) forming over an inner storage tank having a cylindrical-shaped main body and end walls a series of spaced outer wall sections wherein each of said outer wall sections extends circumferentially around the main body such that a mid-portion thereof extends less than about one-half inch from the main body, and further wherein each wall section is from about twelve inches to about sixty inches in width and from about one-half inch to about six inches separated from an adjacent outer wall section such that the outer wall sections cover at least about seventy percent of the main body; and (b) attaching lengthwise edges of each wall section to the cylindrical-shaped main body so as to form an annular containment area thereunder to receive any liquid which may leak from the inner storage tank.

13. The method of claim 12 wherein the wall sections are formed at a distance of from about 1/64 inch to about ½ inch in height from the inner storage tank main body.

14. The method of claim 13 wherein each outer wall section is separated from an adjacent outer wall section by from about one inch to about three inches.

15. The method of claim 14 wherein each outer wall section is from about twelve inches to about thirty-six inches in width.

16. The method of claim 12 wherein the wall sections are formed of fibrous reinforcing material and resinous material.

17. The method of claim 12 further comprising the step of placing a separating material on the inner storage tank at least where the outer wall sections are to be formed to provide a means whereby the outer wall sections remain independent of the inner storage tank other than where the wall sections are attached thereto.

18. The method of claim 17 wherein the separating material is selected from the group consisting of a foam, matting, net, screen and mesh.

19. The method of claim 12 wherein portions of the outer wall sections are in non-sealing contact with the main body other than where the wall sections are attached thereto.

20. The method of claim 12 wherein the areas under the wall sections are provided with access opening for communication so as to allow continuous monitoring of the inner storage tank and outer wall sections to detect leakage.

* * * * *